US010309181B2

(12) United States Patent
Tindle et al.

(10) Patent No.: US 10,309,181 B2
(45) **Date of Patent: *Jun. 4, 2019**

(54) RISER FLUID HANDLING SYSTEM

(71) Applicant: Rowan Companies, Inc., Houston, TX (US)

(72) Inventors: Martin Tindle, Houston, TX (US); Brian Patrick Garrett, Kingwood, TX (US); Nicholas Blake Scholz, Cypress, TX (US)

(73) Assignee: Rowan Companies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/786,892

(22) Filed: Oct. 18, 2017

(65) Prior Publication Data

US 2018/0038183 A1 Feb. 8, 2018

Related U.S. Application Data

(63) Continuation of application No. 14/795,947, filed on Jul. 10, 2015, now Pat. No. 9,803,443, which is a continuation of application No. 13/754,394, filed on Jan. 30, 2013, now Pat. No. 9,109,420.

(51) Int. Cl.

| | |
|---|---|
| ***E21B 7/12*** | (2006.01) |
| ***E21B 17/01*** | (2006.01) |
| ***E21B 19/00*** | (2006.01) |
| ***E21B 33/035*** | (2006.01) |

(52) U.S. Cl.

CPC ..... *E21B 33/035* (2013.01); *E21B 7/12* (2013.01); *E21B 17/01* (2013.01); *E21B 19/004* (2013.01)

(58) Field of Classification Search

CPC ..... E21B 7/12; E21B 17/01; E21B 19/004; E21B 33/035; E21B 33/085

See application file for complete search history.

(56) References Cited

U.S. PATENT DOCUMENTS 3,222,088 A 12/1965 Haeber
3,638,721 A * 2/1972 Harrison ..... E21B 33/064 166/351

(Continued)

FOREIGN PATENT DOCUMENTS

EP 1336721 A2 8/2003
GB 2365044 A 2/2002

OTHER PUBLICATIONS

PCT Search Report and Written Opinion for International Application No. PCT/US2013/023668 dated Oct. 10, 2013.

(Continued)

*Primary Examiner* — Matthew R Buck
(74) *Attorney, Agent, or Firm* — Blank Rome LLP

(57) ABSTRACT

A fluid handling system comprising an annular sealing device and a flow control system to divert fluid flow from an annulus of a riser package to a control system located on a rig. A method of installing a fluid handling system on a riser package from a rig comprises connecting the fluid handling system to an upper end of a riser string, supporting the fluid handling system and the riser string using a first tubular handling device, and lowering the fluid handling system and the riser string to an operating position.

26 Claims, 12 Drawing Sheets

(56) References Cited

U.S. PATENT DOCUMENTS

| | | | | | |
|---|---|---|---|---|---|
| 4,626,135 | A * | 12/1986 | Roche | E21B 21/001 | 166/84.4 |
| 4,828,024 | A * | 5/1989 | Roche | E21B 21/001 | 137/869 |
| 4,832,126 | A * | 5/1989 | Roche | E21B 21/001 | 137/114 |
| 6,273,193 | B1 * | 8/2001 | Hermann | E21B 7/128 | 166/350 |
| 6,352,114 | B1 * | 3/2002 | Toalson | E21B 17/01 | 166/339 |
| 7,380,590 | B2 | 6/2008 | Hughes et al. | | |
| 7,658,228 | B2 * | 2/2010 | Moksvold | E21B 17/01 | 166/345 |
| 7,699,109 | B2 * | 4/2010 | May | E21B 33/085 | 166/339 |
| 8,079,426 | B2 * | 12/2011 | Petersson | B63B 35/4413 | 114/264 |
| 8,413,724 | B2 * | 4/2013 | Carbaugh | E21B 17/085 | 166/344 |
| 8,459,361 | B2 * | 6/2013 | Leuchtenberg | E21B 17/07 | 166/344 |
| 8,678,094 | B2 * | 3/2014 | Banks | E21B 19/002 | 166/352 |
| 9,109,420 | B2 * | 8/2015 | Tindle | E21B 33/035 | |
| 9,803,443 | B2 * | 10/2017 | Tindle | E21B 33/035 | |
| 2008/0210471 | A1 * | 9/2008 | Bailey | E21B 21/08 | 175/48 |
| 2011/0127040 | A1 * | 6/2011 | Humphreys | E21B 17/017 | 166/345 |
| 2011/0253445 | A1 * | 10/2011 | Hannegan | E21B 19/09 | 175/5 |
| 2012/0273218 | A1 * | 11/2012 | Orbell | E21B 17/085 | 166/358 |
| 2013/0014991 | A1 | 1/2013 | Leuchtenberg | | |
| 2013/0168578 | A1 | 7/2013 | Leuchtenberg et al. | | |
| 2013/0233562 | A1 * | 9/2013 | Leuchtenberg | E21B 17/01 | 166/345 |
| 2014/0048331 | A1 * | 2/2014 | Boutalbi | E21B 21/08 | 175/38 |
| 2014/0048731 | A1 | 2/2014 | Leuchtenberg et al. | | |

OTHER PUBLICATIONS

Managed Pressure Operations, "Riser Safety: Riser Gas Handling System," Product Flyer, undated, obtained on Jan. 5, 2017 from http://24kk18jio02x0cikxw1cp1b0.wpengine.netdna-cdn.com/wp-content/uploads/2014/09/Product_Flyer_MPO_RiserSafetySystem.pdf, 2-pgs.

Managed Pressure Operations, "Riser Drilling Device: Below Tension Ring Design," Product Flyer, undated, obtained on Jan. 5, 2017 from http://24kk18jio02x0cikxw1cp1b0.wpengine.netdna-cdn.com/wp-content/uploads/2014/09/Product_Flyer_MPO_RiserDrillingDevice.pdf, 2-pgs.

Managed Pressure Operations, "Riser Pressure System Brings MPD & MCD Capability to Floating Drilling Installations," web page, undated, obtained on Jan. 5, 2017 from http://www.managed-pressure.com/, 1-pg.

Barrett, M., "Deepwater MPD: Jakarta Drilling Superintendents Meeting," dated Oct. 12, 2011, 16-pgs.

Piccolo, B. et al, "System does not require second umbilical, can be resealed after flowing drilling mud at high rates," dated Mar. 7, 2016, obtained on Jan. 5, 2017 from http://www.drillingcontractor.org, 4-pgs.

Managed Pressure Operations, "Riser Gas Handling," web page, undated, obtained on Jan. 5, 2017 from http://www.managed-pressure.com, 1-pg.

Managed Pressure Operations, "MPO's Riser Gas Handling System (RGH) Enhances Safety on Deepwater Rigs," web page, undated, obtained on Jan. 5, 2017 from http://www.managed-pressure.com, 2-pgs.

Declaration of Martin Tindle concerning presentation document from Managed Pressure Operations ("MPO") entitled "Pushing the Deepwater Drilling Envelope" indicated as being a second revision with a date of Feb. 27, 2012.

Piccolo, B. et al, "Mechanical pressure relief system protects riser against overpressure during MPD, riser gas handling," dated Mar. 7, 2016, obtained on Jan. 5, 2017 from http://www.drillingcontractor.org, 5-pgs.

Supplemental Examination Certificate in Re-exam No. 96/000,245 for U.S. Pat. No. 9,109,420, dated Mar. 19, 2018, 9-pgs.

Office Action in U.S. Appl. No. 96/000,245, dated May 31, 2018, 9-pgs.

* cited by examiner

RISER FLUID HANDLING SYSTEM

CROSS-REFERENCE TO RELATED APPLICATION

This application is a continuation of U.S. application Ser. No. 14/795,947, filed Jul. 10, 2015, which is a continuation of U.S. patent application Ser. No. 13/754,394, filed Jan. 30, 2013, both of which are herein incorporated by reference in their entireties.

FIELD OF THE DISCLOSURE

Embodiments of the invention generally relate to a fluid handling system for controlling fluid flow through a riser package.

DESCRIPTION OF THE RELATED ART

For many years, drilling riser systems have provided the ability to access offshore hydrocarbon reservoirs located thousands of feet below the seafloor. In 2010, however, the Macondo well incident revealed a need for improved riser package safety systems capable of responding to an uncontrolled release of wellbore fluids. Current blow-out prevention systems provide only one point of shut off at the base of a riser string. In the event of a blow-out prevention system failure, such as in the Macondo well incident, the uncontrolled release of high pressure wellbore fluids may flow freely up through the entire riser package to the rig floor, thereby endangering worker safety and potentially damaging rig equipment. In addition, other equipment above the blow-out prevention systems, such as a mud-gas separator, do not provide any control mechanism for handling uncontrolled, high-pressure released wellbore fluids at the surface of the rig. Damage to or failure of this type of rig equipment by the uncontrolled release of wellbore fluids may potentially expose the surrounding environment to contamination by the wellbore fluids.

Therefore, there is a need for a new and improved system capable of handling uncontrolled wellbore fluid flow through a riser package.

SUMMARY OF THE DISCLOSURE

In one embodiment, a riser package for use on a rig comprises an annular sealing device coupled below a telescopic joint, wherein the annular sealing device is operable to completely close off fluid flow through a flow bore of the annular sealing device to prevent fluid from flowing up through a flow bore of the riser package past the annular sealing device; and a flow control device coupled below the annular sealing device, wherein the flow control device is operable to divert fluid flowing up through the flow bore of the riser package to a control system located on the rig.

In one embodiment, a riser package for use on a rig comprises an annular sealing device coupled below a telescopic joint, wherein the annular sealing device is operable to sealingly engage a tubular string disposed through the riser package, wherein the annular sealing device comprises a non-rotating sealing element to sealingly engage the tubular string; and a flow control device coupled below the annular sealing device, wherein the flow control device is operable to divert fluid flow from an annulus formed between an outer surface of the tubular string and an inner surface of the riser package to a control system located on the rig.

In one embodiment, a method of handling fluid flow through a riser package that is supported by a rig comprises providing an annular sealing device operable to completely close off fluid flow through a flow bore of the annular sealing device to prevent fluid from flowing up through a flow bore of the riser package past the annular sealing device, wherein the annular sealing device is coupled below a telescopic joint of the riser package; and providing a flow control device operable to divert fluid flowing up through the flow bore of the riser package to a control system located on the rig, wherein the flow control device is coupled below the annular sealing device.

In one embodiment, a method of handling fluid flow through a riser package that is supported by a rig comprises providing an annular sealing device operable to sealingly engage a tubular string disposed through the riser package, wherein the annular sealing device comprises a non-rotating sealing element to sealingly engage the tubular string, and wherein the annular sealing device is coupled below a telescopic joint; and providing a flow control device operable to divert fluid flow from an annulus formed between an outer surface of the tubular string and an inner surface of the riser package to a control system located on the rig, wherein the flow control device is coupled below the annular sealing device In one embodiment, a method of installing a riser package for use on a rig comprises lowering a riser string through a first tubular handling device located on the rig floor; supporting the riser string using a second tubular handling device located below the first tubular handling device; connecting the fluid handling system to the riser string; supporting the fluid handling system and the riser string using the first tubular handling device; and lowering the fluid handling system and the riser string to an operating position.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
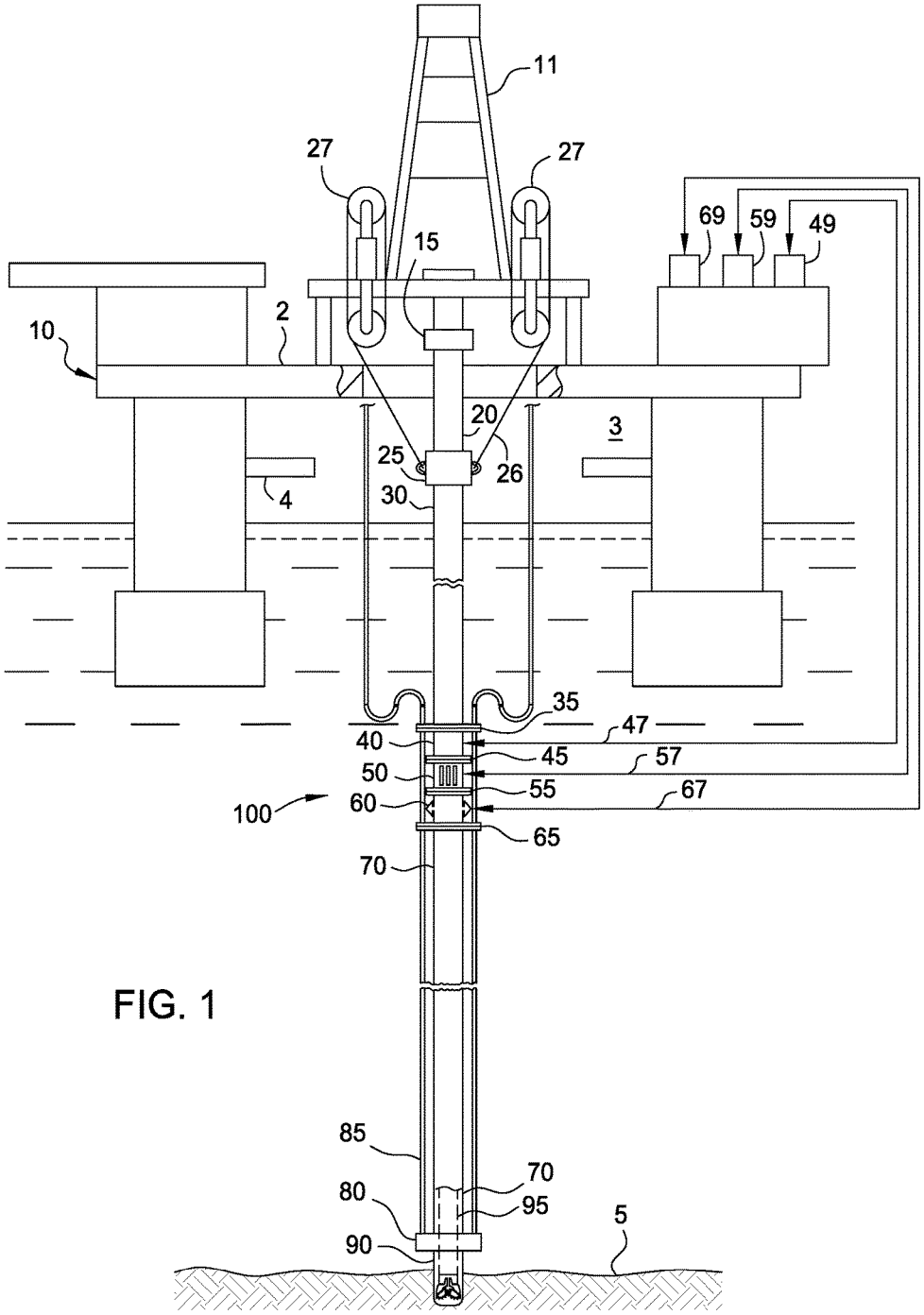
FIG. 1 illustrates a schematic view of a riser system, according to one embodiment.

FIG. 1 illustrates a riser package 100 supported by a rig 10 having a drilling system 11, according to one embodiment. The riser package 100 may include a diverter/flexible joint 15, an upper telescopic joint section 20, a slip ring 25, a lower telescopic joint section 30, a rotating control device 40, an annular blow out preventer (BOP) 50, a flow control device 60, and a riser string 70. The riser string 70 may be coupled to one or more annular and/or ram-style blow out preventers (BOP's) 80. The BOP's 80 may be coupled to a subsea wellhead 90 disposed in the seafloor 5.

One or more control lines 85 may provide communication between the BOP's 80 and equipment on the rig 10. The control lines 85 may be supported by one or more structural connections disposed along the riser package 100. As illustrated, the control lines are supported by a flanged section 35 between the lower telescopic joint section 30 and the rotating control device 40, and a flanged section 65 between the flow control device 60 and the riser string 70.

The rig 10 may include a floating, fixed, or semi-submersible platform or vessel as known in the art. The rig 10 may include conventional control and power systems, rotary tables, spiders, and/or other tubular handling equipment used to drill and form one or more wellbores through the seafloor 5. The drilling system 11 may include any conventional drilling system as known in the art for installing and/or supporting the riser package 100, the BOP's 80, and the subsea wellhead 90. The drilling system 11 may include conventional control and power systems, top drives, elevators, and/or other tubular handling equipment used to drill and form one or more wellbores through the seafloor 5 using the drill string 95. The drill string 95 may include a jointed tubular string or a coiled tubing string that is supported and rotated by the drilling system 11 to form one or more subsea wellbores.

A moon pool 3 as known in the art includes an area disposed below the rig floor 2 and positioned under the drilling system 11 through which tools and equipment, such as one or more of the riser package 100 components, are lowered to the seafloor 5. A trolley 4 (e.g. a movable platform) coupled to the rig 10 may be positioned in the moon pool 3. The trolley 4 may be laterally movable along guide rails to position tools and equipment, such as one or more of the riser package 100 components, in and out of alignment with the center of the drilling system 11 and thus the subsea wellbore.

The riser package 100 may be configured to guide drill strings, tools, and other equipment from the rig 10 to the subsea wellhead 90. The riser package 100 also may be configured to direct drilling fluids, wellbore fluids, and earth-cuttings from the subsea wellbore to the rig 10. In the event, of an uncontrolled release of wellbore fluids (e.g. high pressure liquid and/or gas streams), the riser package 100 is configured to divert the uncontrolled wellbore fluid flow to a control system in a controlled and safe manner as further described herein.

The diverter/flexible joint 15 may be operable to direct drilling fluids, wellbore fluids, and earth-cuttings to one or more separation units and/or processing units. For example, the diverter/flexible joint 15 may direct these return fluids to a mud-gas separator as known in the art, to separate out the drilling fluid for potential recycle and reuse, and to separate out the gas for proper disposal. The diverter/flexible joint 15 also may be operable to permit the riser package 100 to angularly deflect in the event that the rig 10 moves laterally from directly over the subsea wellhead 90.

The upper and lower telescopic joint sections 20, 30 may be operable to compensate for the heave, raising and lowering, of the rig 10 by the sea as known in the art. The upper telescopic joint section 20 may telescope or move into and out of the lower telescopic joint section 30 with the heave of the rig 10, while the lower portion of the riser package 100 remains relatively stationary. The upper and lower telescopic joints sections 20, 30 are secured to the rig 10 by the slip ring 25, which includes one or more cables 26 that are spooled to tensioners 27 disposed on the rig 10. The tensioners 27 are operable to maintain an upward pull on the riser package 100 to prevent the riser package 100 from buckling under its own weight. The tensioners 27 are adjustable to allow adequate support for the riser package 100.

The rotating control device 40 is coupled below the lower telescopic joint section 30 by the flanged connection 35. The rotating control device 40 may include any conventional rotating control device operable to sealingly engage a rotating (or non-rotating) drill string for conducting a managed pressure drilling operation as known in the art. The rotating control device 40 may include a rotatably mounted sealing element for sealing off the annulus formed radially between the drill string and an outer body of the rotating control device 40 when actuated. The sealing element may be mechanically squeezed radially inward by one or more hydraulically actuated pistons to seal on the drill string. Examples of a rotating control device that may be used with the embodiments discussed herein are the rotating control devices 20, 23 as described in US Patent Publication 2012/0255783, the contents of which are herein incorporated by reference.

One or more control lines 47 may provide communication between the rotating control device 40 and a control system 49 located on the rig 10. The control lines 47 may include hydraulic, electric, and/or pneumatic lines for sending and/or receiving signals to and from the rotating control device 40. The control lines 47 also may be configured to supply and/or return fluid to and from the rotating control device 40 for operation. The control system 49 may include any number and arrangement of conventional programmable logic controllers, power units, valves, chokes, manifolds, etc. for controlling, managing, and/or monitoring the operation of the rotating control device 40.

The annular BOP 50 is coupled below the rotating control device 40 by a flanged connection 45. The annular BOP 50 may include any conventional sealing device operable to sealingly engage a non-rotating (or rotating) drill string for preventing fluid flow up through the annulus of the riser package 100 past the annular BOP 50. The annular BOP 50 may include a sealing element for sealing off the annulus formed radially between the drill string and an outer body of the annular BOP 50 when actuated. The sealing element may be mechanically squeezed radially inward by one or more hydraulically actuated pistons to seal on the drill string. One or more accumulators may be secured to the annular BOP 50 to provide a direct hydraulic supply to the pistons for rapid actuation and thus rapid sealing against the drill string. The annular BOP 50 may be substantially similar to the rotating control device 40 and/or one or more of the BOP's 80. Examples of an annular sealing device and a rotating control device that can be used with the embodiments discussed herein are the annular BOP's and RCD's as described in US Patent Publication 2012/0273218, the contents of which are herein incorporated by reference.

One or more control lines 57 may provide communication between the annular BOP 50 and a control system 59 located on the rig 10. The control lines 57 may include hydraulic, electric, and/or pneumatic lines for sending and/or receiving signals to and from the annular BOP 50. The control lines 57 also may be configured to supply and/or return fluid to and from the annular BOP 50 for operation. The control system 59 may include any number and arrangement of conventional programmable logic controllers, power units, valves, chokes, manifolds, etc. for controlling, managing, and/or monitoring the operation of the annular BOP 50.

The flow control device 60 is coupled below the annular BOP 50 by a flanged connection 55. The flow control device 60 may include one or more hydraulically actuated valves for directing fluid flow from the annulus of the riser package 100 to one or more control systems located on the rig 10. The flow control device 60 may include a central flow bore and one or more lateral flow bores that intersect the central flow bore. The hydraulically actuated valves may open and close fluid flow through the lateral flow bores when necessary. One or more accumulators may be secured to the flow control device 60 to provide a direct hydraulic supply to the valves for rapid actuation and thus rapid opening and closing of fluid flow through the lateral flow bores.

One or more control lines 67 may provide communication between the flow control device 60 and a control system 69 located on the rig 10. The control lines 67 may include hydraulic, electric, and/or pneumatic lines for sending and/or receiving signals to and from the flow control device 60. The control lines 67 also may be configured to supply and/or return fluid to and from the flow control device 60 for operation. The control system 69 may include any number and arrangement of conventional programmable logic controllers, power units, valves, chokes, manifolds, etc. for controlling, managing, and/or monitoring the operation of the flow control device 60.

The riser string 70 may be coupled below the flow control device 60 by the flanged connection 65. The riser string 70 may include one or more tubular joints that are coupled together to form a central bore for receiving and directing drilling tools, drilling fluids, wellbore fluids, etc. The lower end of the riser string 70 may be coupled to the BOP's 80 by a flanged connection.

The BOP's 80 may include a stack of annular and/or ram-style blow out preventers as known in the art. One or more of the BOP's 80 may be the same or similar to the annular BOP 50 discussed above. The BOP's 80 may be actuated to shut-in the subsea wellhead 90 and prevent wellbore fluids from flowing up through the riser package 100. Examples of BOP's that can be used with the embodiments discussed herein are the BOP's as described in US Patent Publication 2012/0273218, the contents of which are herein incorporated by reference.

In operation, the drill string 95 may be lowered through the riser package 100 and rotated by the drilling system 11 to drill a subsea wellbore. Although described herein with respect to a drill string 95, embodiments of the invention may be used with any other tubular string that is lowered through the riser package 100. The rotating control device 40 may sealingly engage the rotating drill string 95 to conduct a managed pressure drilling operation as known in the art. Drilling fluids or other completion-type fluids may be supplied through the drill string 95 and/or through one or more of the control lines 47 in communication with the rotating control device 40. Return fluids (such as drilling fluids, wellbore fluids, and earth-cuttings) may flow up through the annulus of the riser package 100, i.e. the area between the outer surface of the drill string 95 and the inner surface of the riser package 100. The return fluids may flow up through the annulus of the riser package 100 to the rotating control device 40, and may be directed through the control lines 47 to the control system 49 on the rig 10 for further processing and handling by one or more separation/processing units as known in the art. In one embodiment, the rotating control device 40 may not be actuated into engagement with the drill string 95, and the return fluids may flow up the riser package 100 and directed by the diverter/flexible joint 15 to one or more separation/processing units for further processing and handling as known in the art.

In the event of a (high pressure) uncontrolled release of wellbore fluids, the annular BOP 50 may be actuated by the control system 59 to sealingly engage the drill string 95 to close off fluid flow up through the annulus of the riser package 100 past the annular BOP 50. The rotation of the drill string 95 may be stopped so that the annular BOP 50 engages the drill string 95 when it is not rotating. Alternatively, the annular BOP 50 may be configured to sealingly engage the drill string 95 when rotating. In one embodiment, the accumulators on the annular BOP 50 may be actuated by the control system 59 to rapidly close the annular BOP 50 around the drill string 95 to prevent the uncontrolled release of wellbore fluids from flowing up through the riser package 100 to the rig 10.

The flow control device 60 also may be actuated to open fluid flow through one or more control lines 67 that are in fluid communication with the annulus of the riser package 100. The flow control device 60 may be actuated by the control system 69 to rapidly open and divert the uncontrolled release of wellbore fluids from the annulus of the riser package 100. The flow control device 60 may divert the uncontrolled release of wellbore fluids through the one or more control lines 67 to the control system 69, which is configured to safely and efficiently handle the (high-pressure) uncontrolled wellbore fluid stream. In this manner, the annular BOP 50 and the flow control device 60 may collectively operate as a fluid handling system operable to handle an uncontrolled wellbore fluid flow up through the annulus of the riser package 100.

Figure 2A:
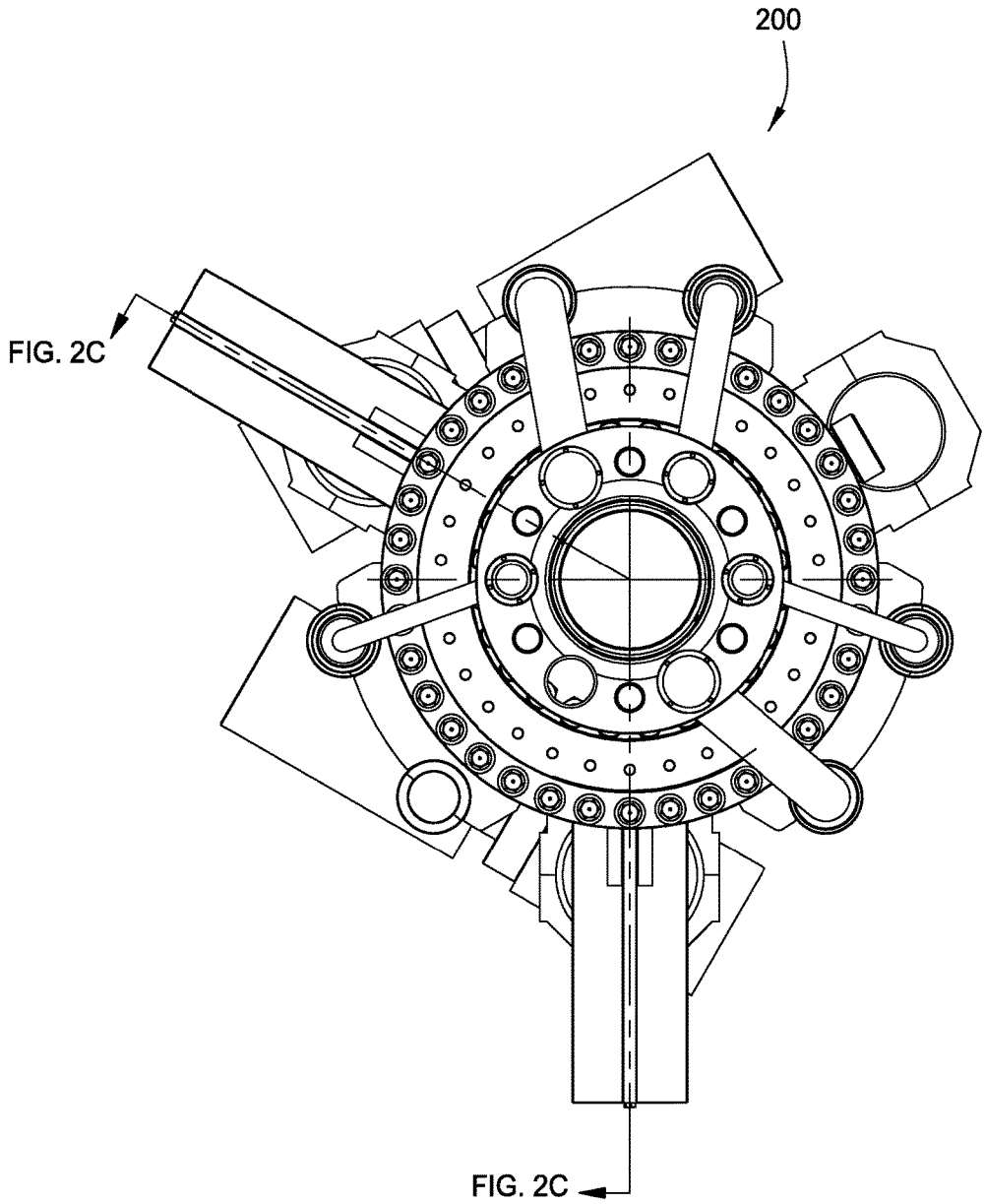
FIGS. 2A-2C illustrate a fluid handling system, according to one embodiment.
Figure 2B:
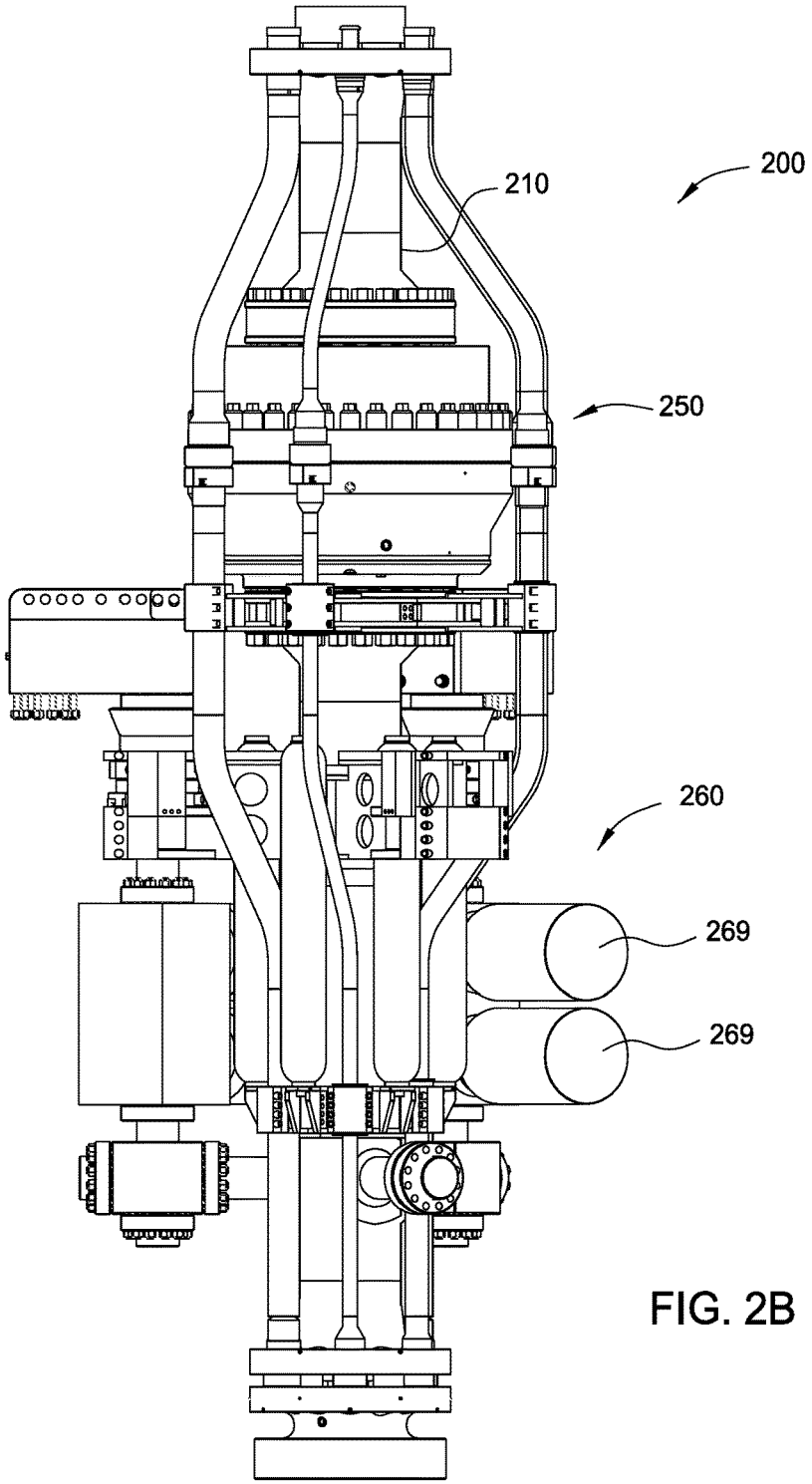
Figure 2C:
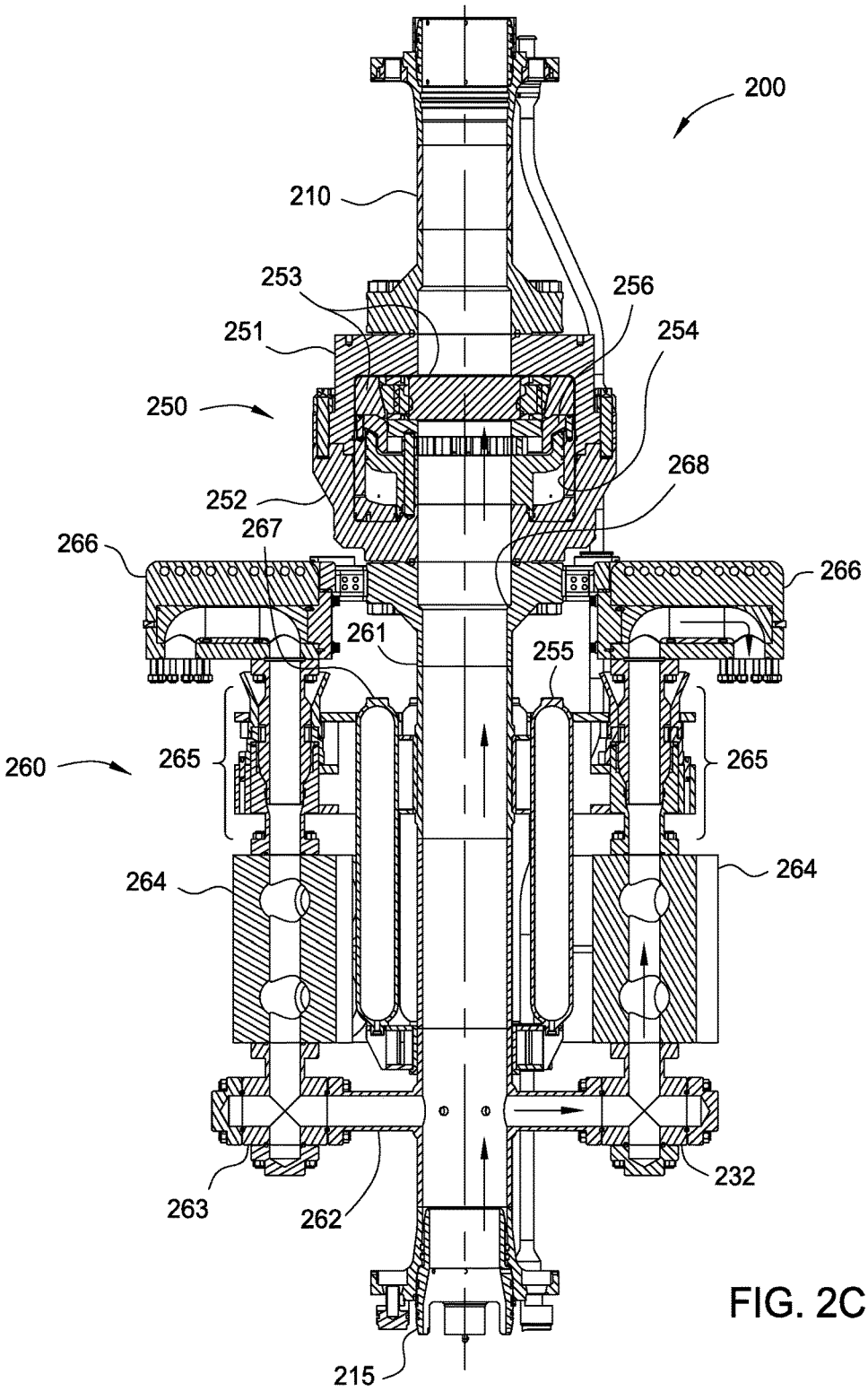

FIGS. 2A-2C illustrate a fluid handling system 200, according to one embodiment. FIG. 2A is a top view of the fluid handling system 200. FIG. 2B is a side view of the fluid handling system 200. FIG. 2C is a sectional view of the fluid handling system 200. The fluid handling system 200 may be coupled to the riser package 100 in place of the annular BOP 50 and the flow control device 60. The fluid handling system 200 may operate in a similar manner as the annular BOP 50 and the flow control device 60 as described above. The fluid handling system 200 may be operable to prevent uncontrolled wellbore fluid flow from flowing up through the riser package 100 by diverting the flow to a control system on the rig 10 configured to handle the uncontrolled wellbore fluid flow.

The fluid handling system 200 may include an annular sealing device 250 and a flow control device 260. The annular sealing device 250 may be substantially similar to the annular BOP 50 described above. The flow control device 260 may be substantially similar to the flow control device 60 described above.

Referring to FIG. 2C, the fluid handling system 200 may include an upper adapter 210 for coupling the fluid handling system 200 to the rotating control device 40 or any other upper component of the riser package 100. The fluid handling system 200 also may include a lower adapter 215 for coupling the fluid handling system 200 to the riser string 70 or any other lower component of the riser package 100. The upper and lower adapters 210, 215 may include tubular member having flow bores for communicating fluid through the flow bore of the riser package 100.

The annular sealing device 250 may include an upper tubular body 251 coupled to a lower tubular body 252 that form a flow bore through the annular sealing device 250. Fluid may freely flow through the flow bore of the annular sealing device 250 to the upper adapter 210 when in an open position. One or more annular sealing elements 253 (such as an elastomeric or rubber packer) may be supported in the upper and lower bodies 251, 252. One or more hydraulically actuated pistons 254 may be coupled to one or more plate members 256 for forcing (e.g. wedging) the sealing elements 253 radially inward into a sealing position. The annular sealing device 250 may include static, non-rotating type seals or dynamic, rotating type seals to sealingly engage the drill string 95 or other tubular string disposed through the riser package 100. The annular sealing device 250 and/or the sealing elements 253 may be stationary, e.g. non-rotating, while the drill string 95 or other tubular string disposed through the annular sealing device 250 is rotating.

When the annular sealing device 250 is in an open position, fluid may flow up the annulus of the riser package 100 past the sealing element 253. When the annular sealing device 250 is in a closed position, fluid may not flow up the annulus of the riser package 100 past the sealing element 253. In one embodiment, the piston 254 may be hydraulically actuated to force the annular sealing element 253 radially inward to completely close and/or seal off the entire flow bore of the annular sealing device 250 to prevent any fluid flow through the flow bore past the annular sealing device 250. In one embodiment, the piston 254 may be hydraulically actuated to force the annular sealing element 253 radially inward into engagement with the drill string 95 or any other tubular string (not illustrated for clarity) to prevent fluid flow up through the annulus of the riser package 100. The annular sealing device 50 may be operable to sealingly engage the drill string 95 or other tubular string when it is not rotating or when it is rotating to prevent fluid flow up through the annulus of the riser package 100 past the sealing element 253. Therefore, the annular sealing device 250 may be actuated to prevent fluid flow up through the riser package 100 with or without the drill string 95 or any other tubular string located through the riser package 100. One or more accumulators 255 may be used to provide a direct hydraulic supply to the piston 254 for rapid actuation and thus rapid sealing against the drill string 95. The one or more control lines 57 discussed above may provide communication between the annular sealing device 250 and the control system 59 located on the rig 10.

The flow control device 260 is coupled below the annular sealing device 250 by a flanged connection. The flow control device 260 may include a body 261 having a central flow bore, and one or more lateral flow bores 262 that intersect the central flow bore. Fluid may flow through the flow bores of the body 261, the annular sealing device 250, and the upper and lower adapters 210, 215. The flow control device 260 may include one or more sealed flow connectors 263 for providing fluid communication between the lateral flow bores 262 and one or more hydraulically actuated valves 264.

The valves 264 are operable to open and close fluid flow from the annulus of the riser package 100 to one or more control systems located on the rig 10. One or more sealed flow connectors 265 and gooseneck connectors 266 may be coupled to the valves 264 for directing fluid flow to the one or more control lines 67 as discussed above. One or more accumulators 267 may be secured to the flow control device 60 to provide a direct hydraulic supply to the valves 264 for rapid actuation and thus rapid opening and closing of fluid flow through the lateral flow bores 262. The body 261 may include a shoulder or other similar profile 268 that can be used to land a sealing device to pressure test the annular sealing device 250 and verify its operating condition.

When the valves 264 are in a closed position, fluid may be prevented from flowing through the lateral flow bores 262 past the valves 264. When the valves 264 are in an open position, fluid may flow through the lateral flow bores 262 past the valves 264. The valves 264 may include hydraulically actuated gate valves. In particular, the gates of the valves 264 may be hydraulically actuated by the one or more piston cylinders 269 (illustrated in FIG. 2B) to open fluid flow through the flow bores of the valves 264 such that fluid may flow from the annulus of the riser package 100 to the lateral flow bores 262 and to the one or more control lines 67 (as discussed above) via the flow connectors 265 and the gooseneck connectors 266.

In the event of a (high-pressure) uncontrolled release of wellbore fluids, the annular sealing device 250 may be actuated to sealingly engage the drill string 95 to close off fluid flow up through the annulus of the riser package 100 past the annular sealing device 250. The rotation of the drill string 95 may be stopped so that the annular sealing device 250 engages the drill string 95 when it is not rotating. Alternatively, the annular sealing device 250 may be configured to sealingly engage the drill string 95 when rotating. In one embodiment, the accumulators 255 may be actuated by the control system 59 to rapidly close the annular sealing device 50 around the drill string 95 to prevent the uncontrolled release of wellbore fluids from flowing up through the riser package 100 to the rig 10.

The valves 264 of the flow control device 260 also may be actuated to open fluid flow through the lateral bores 262 that are in fluid communication with the annulus of the riser package 100. The valves 264 may be actuated by the control system 69 to rapidly open and thereby divert the uncontrolled release of wellbore fluids from the annulus of the riser package 100 to the one or more control lines 67. The flow control device 60 may divert the uncontrolled release of wellbore fluids through one or more control lines 67 to the control system 69, which is configured to safely and efficiently handle the (high-pressure) uncontrolled wellbore fluid stream. In this manner, the fluid handling system 200 is operable to handle an uncontrolled wellbore fluid flow up through the annulus of the riser package 100.

Figure 3:
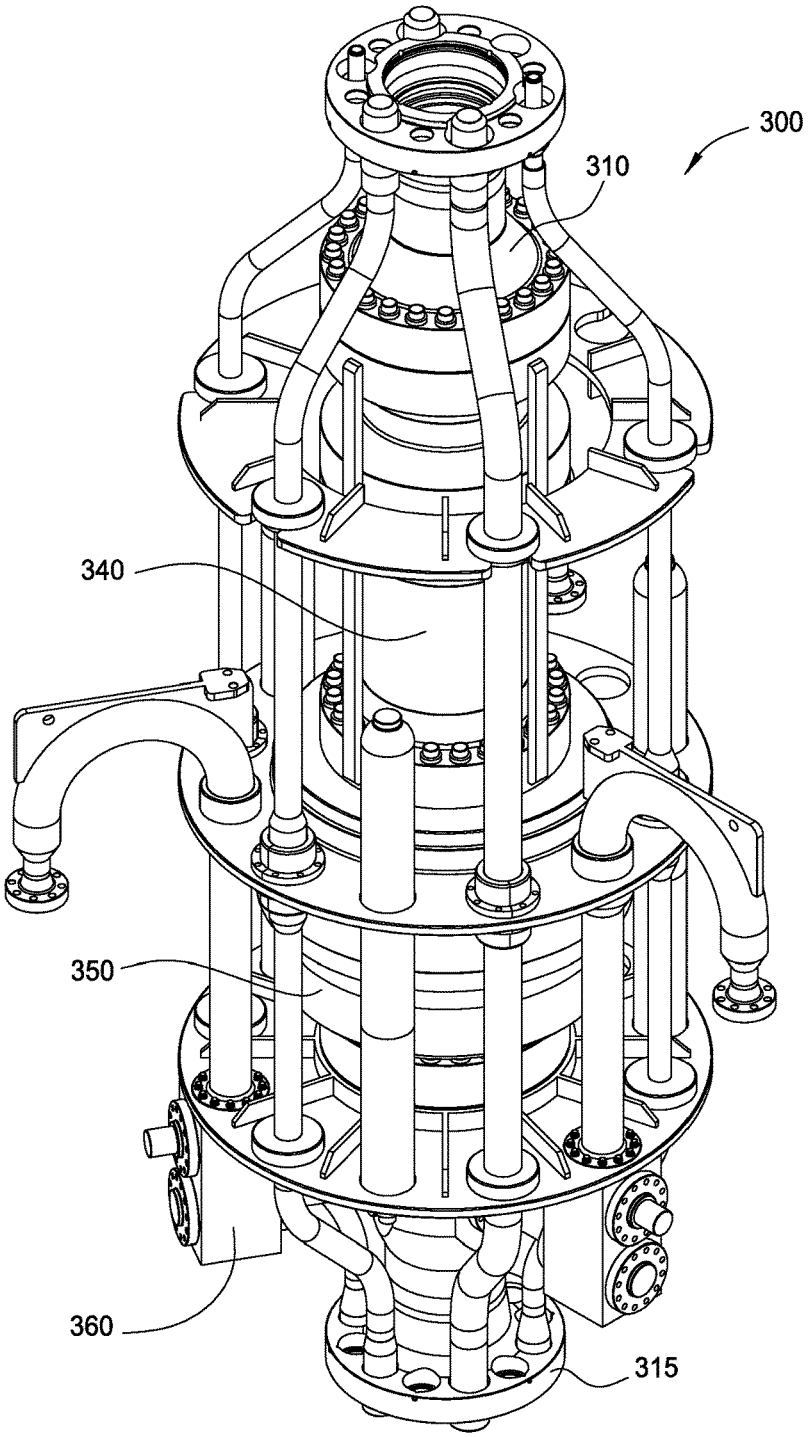
FIG. 3 illustrates another fluid handling system, according to one embodiment.

FIG. 3 illustrates another fluid handling system 300, according to one embodiment. The fluid handling system 300 may include a rotating control device 340, an annular sealing device 350, and a flow control device 360. The rotating control device 340 may be substantially similar to the rotating control device 40 described above, the operation of which will not be repeated herein for brevity. Alternatively, the rotating control device 340 may comprise a dummy spool having a central flow bore that is in fluid communication with the flow bore of the riser package 100. The annular sealing device 350 may be substantially similar to the annular BOP 50 and/or the annular sealing device 250 described above, the operations of which will not be repeated herein for brevity. The flow control device 360 may be substantially similar to the flow control devices 60, 260 described above, the operations of which will not be repeated herein for brevity. Upper and lower tubular adapters 310, 315 may be provided to couple the fluid handling system 300 to the riser package 100.

FIGS. 4A-4D illustrate various control systems 69 that may be used with any of the fluid handling systems described herein. The control systems 49, 59 may be substantially similar to the control systems 69. One or more combinations of the control systems and/or fluid handling system are contemplated for use with the embodiments described herein. One or more of the valves of the fluid handling systems described herein may be selectively and/or individually operated for different operations as desired.

Figure 4A:
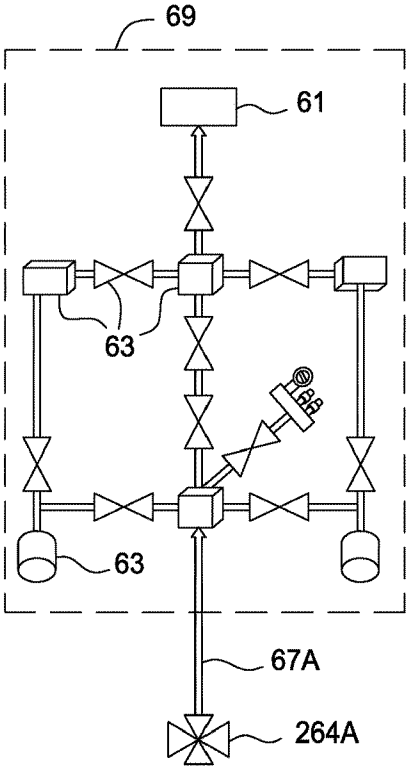
FIGS. 4A-4D illustrate various control systems in communication with the fluid handling system, according to one or more embodiments.

FIG. 4A illustrates one of the valves 264A of the fluid handling system 200 that may be in communication with the control system 69 located on the rig 10 via at least one control line 67A. In one embodiment, an uncontrolled wellbore fluid stream may be diverted to the control system 69 by opening the valve 264A. In one embodiment, return fluids, including drilling fluids, wellbore fluids, and/or earth cuttings may be directed to the control system 69 by opening the valve 264A for conducting a managed pressure drilling operation as known in the art. The fluid stream may be directed through the control line 67A to a control manifold of the control system 69 comprised of various valves, chokes, hydraulic blocks, etc., identified as items 63, arranged to reduce the flow rate and pressure of the fluid stream for safe and efficient handling. The fluid stream may then safely be directed to a separation unit 61, such as a mud-gas separator, to separate the fluid stream into one or more components. For example, high pressure gas may be separated from the fluid stream and sent to a flare system for disposal as known in the art.

Figure 4B:
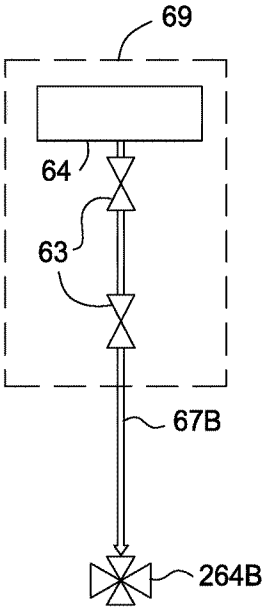

FIG. 4B illustrates one of the valves 264B of the fluid handling system 200 that may be in communication with the control system 69 located on the rig 10 via at least one control line 67B. Fluid may be injected into the annulus of the riser package 100 via the control line 67B when the valve 264B is open. A fluid supply 64 located on the rig 10 may supply fluid through a control manifold of the control system 69 comprised of various valves, chokes, hydraulic blocks, etc., identified as items 63, arranged to supply fluid to the fluid handling system 200 or any other component of the riser package 100 in a safe and efficient manner. For example, a drilling fluid may be supplied form the fluid supply 64 to the annulus of the riser package 100 via the control line 67B and the fluid handling system 200 when conducting a managed pressure drilling operation as known in the art.

Figure 4C:
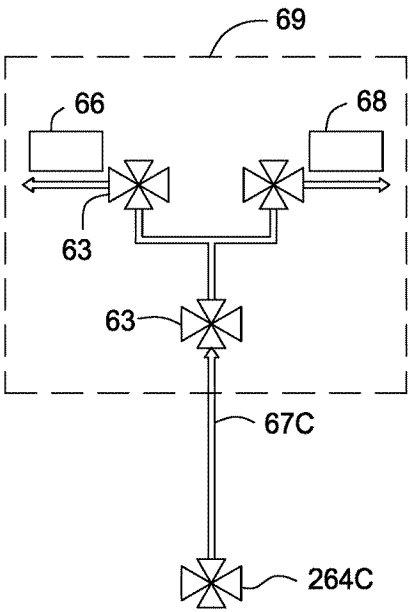

FIG. 4C illustrates one of the valves 264C of the fluid handling system 200 that may be in communication with the control system 69 located on the rig 10 via at least one control line 67V. An over-pressurized wellbore fluid stream may be diverted to the control system 69 by opening the valve 264C. The fluid stream may be directed through the control line 67C to a control manifold of the control system 69 comprised of various valves, chokes, hydraulic blocks, etc., identified as items 63, arranged to reduce the flow rate and pressure of the fluid stream for safe and efficient handling. As an additional or back-up safety measure, the control manifold may be arranged to selectively direct the fluid stream over the port 66 or starboard 68 side of the rig 10 for handling as necessary or expelling into the environment for worker safety.

Figure 4D:
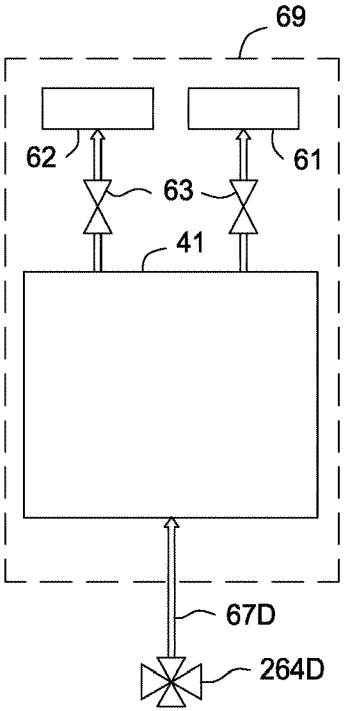

FIG. 4D illustrates one of the valves 264D of the fluid handling system 200 that may be in communication with the control system 69 located on the rig 10 via at least one control line 67D. A return fluid stream, including drilling fluids, wellbore fluids, and/or earth cuttings, may be directed to the control system 69 by opening the valve 264D for conducting a managed pressure drilling operation as known in the art. The fluid stream may be directed through the control line 67D to a managed pressure drilling manifold 41 and/or a control manifold of the control system 69 comprised of various valves, chokes, hydraulic blocks, etc., identified as items 63, arranged to process fluid stream for safe and efficient handling. The fluid stream may then selectively be directed to a separation unit 61, such as the mud-gas separator, to separate the fluid stream into one or more components. The fluid stream also may then selectively be directed to a rig shaker 62 as known in the art to separate solid components from the fluid stream.

FIGS. 5-11 illustrate an installation sequence of the fluid handling system 200, according to one embodiment. Although described with respect to the fluid handling system 200, one or more of the installation sequence steps may be used to install any of the fluid handling systems described herein.

Figure 5:
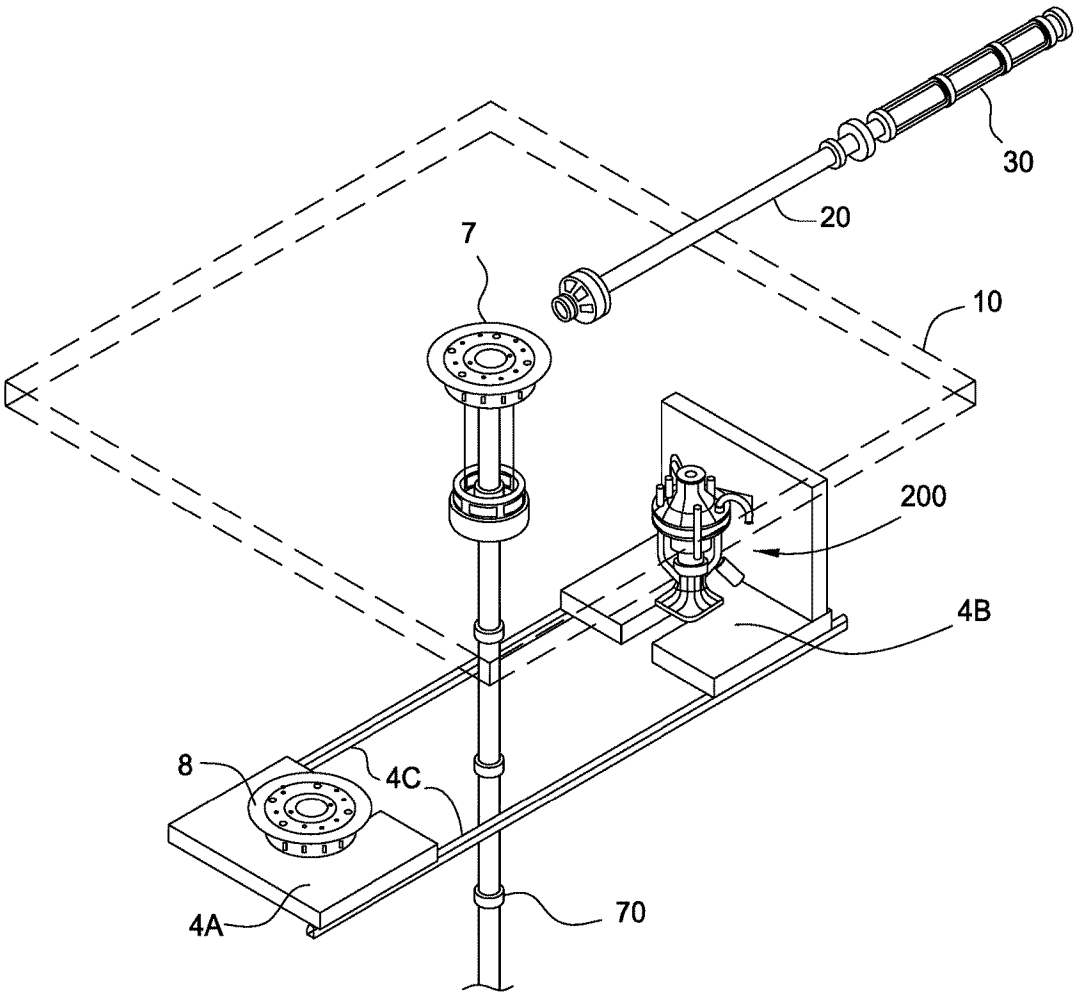
FIGS. 5-10 illustrate an installation sequence of the fluid handling system, according to one embodiment.

FIG. 5 illustrates the rig 10 having a first tubular support device 7, such as a spider and/or rotary table as known in the art, for supporting and handling the riser package 100. Below the floor of the rig 10 in the moon pool area, a first trolley 4A and a second trolley 4B are independently and laterally movable along one or more guiderails 4C to position one or more components of the riser package 100 into and out of alignment with the tubular support device 7 and thus the center of the subsea wellbore. The first trolley 4A may include a second tubular support device 8, such as a spider and/or rotary table as known in the art, for further support and handling of the riser package 100. The fluid handling device 200 may be disposed on the second trolley 4B in the moon pool area.

In FIG. 5, the BOP's 80 and the riser string 70 are conventionally installed using conventional running tools of the drilling system 11. The upper end of the riser string 70 is supported from the rig 10 by the first tubular handling device 7. After last joint of the riser string 70 is deployed, the telescopic joint 20, 30 may be moved into position on the rig 10 for installation.

Figure 6:
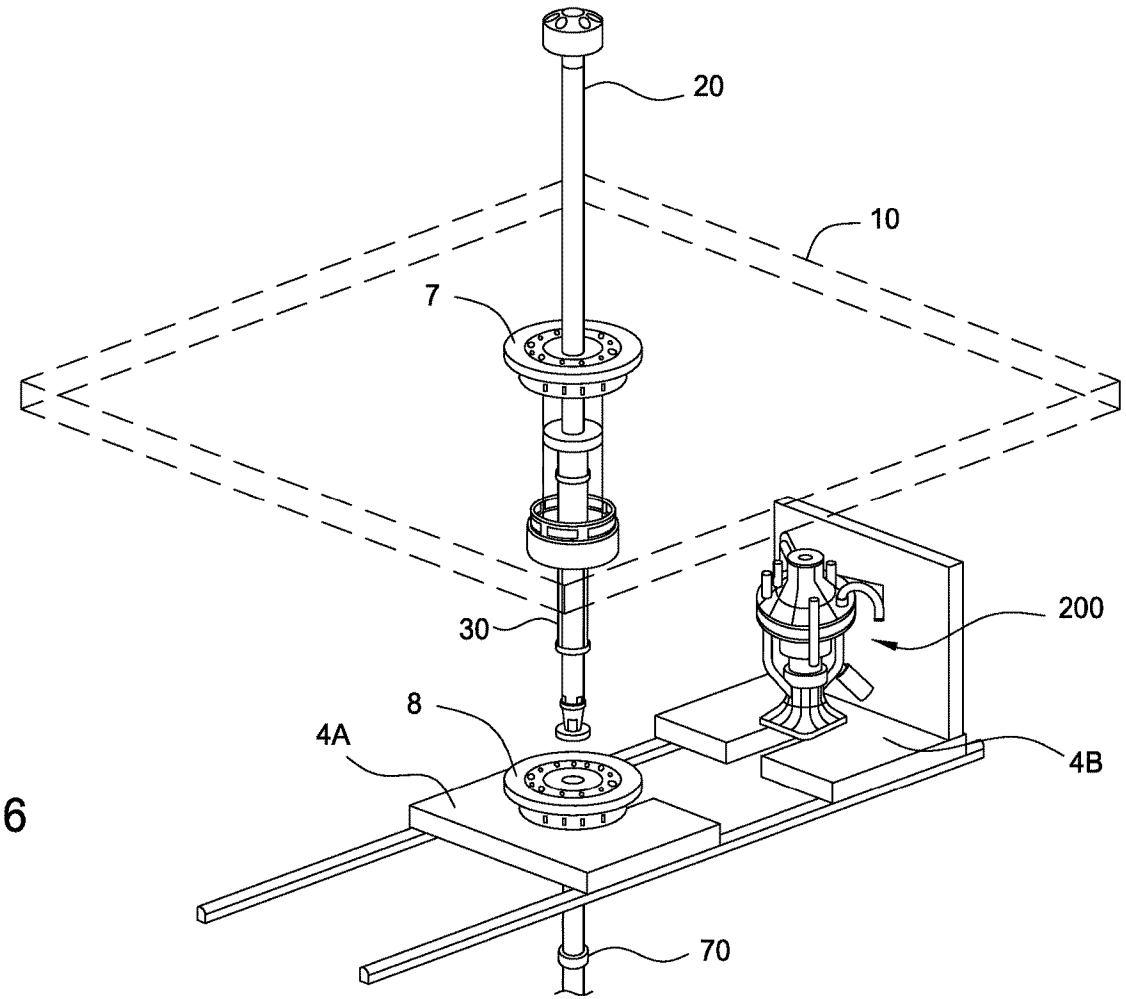

In FIG. 6, the riser string 70 is lowered using conventional running tools of the drilling system 11, and/or by the telescopic joint 20, 30 to a position where the first trolley 4A can move the second tubular handling device 8 into engagement with the riser string 70. In particular, the second tubular handling device 8 may be spread open such that it can enclose or clamp around the riser string 70. When the riser string 70 is supported by the second tubular handling device 8, the running tool and/or telescopic joint 20, 30 may be disconnected and raised out of the way for installation of the fluid handling system 200.

Figure 7:
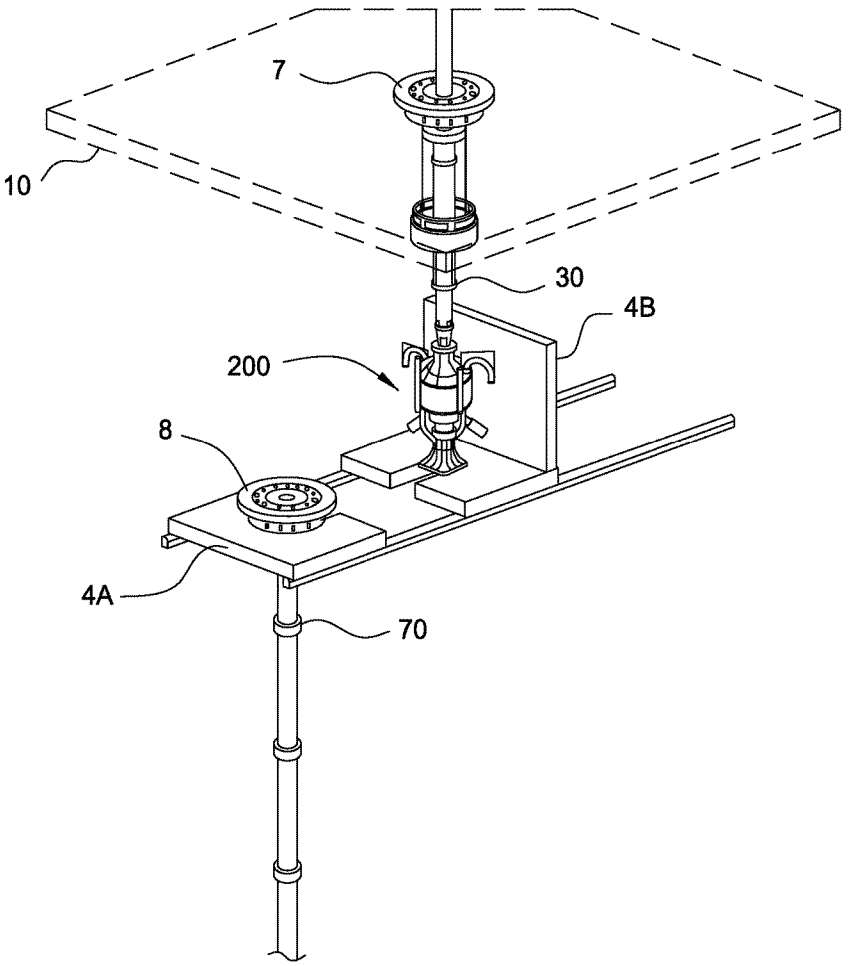

In FIG. 7, the first trolley 4A moves the riser string 70 out of alignment with the first tubular handling tool 7 and thus the subsea well center. The second trolley 4B however moves the fluid handling system 200 into alignment with the first tubular handling tool 7. The telescopic joint 20, 30 may be lowered for connection to the upper end of the fluid handling system 200, such as by a flanged connection. The fluid handling system 200 may also be disconnected from the second trolley 4B if coupled thereto.

Figure 8:
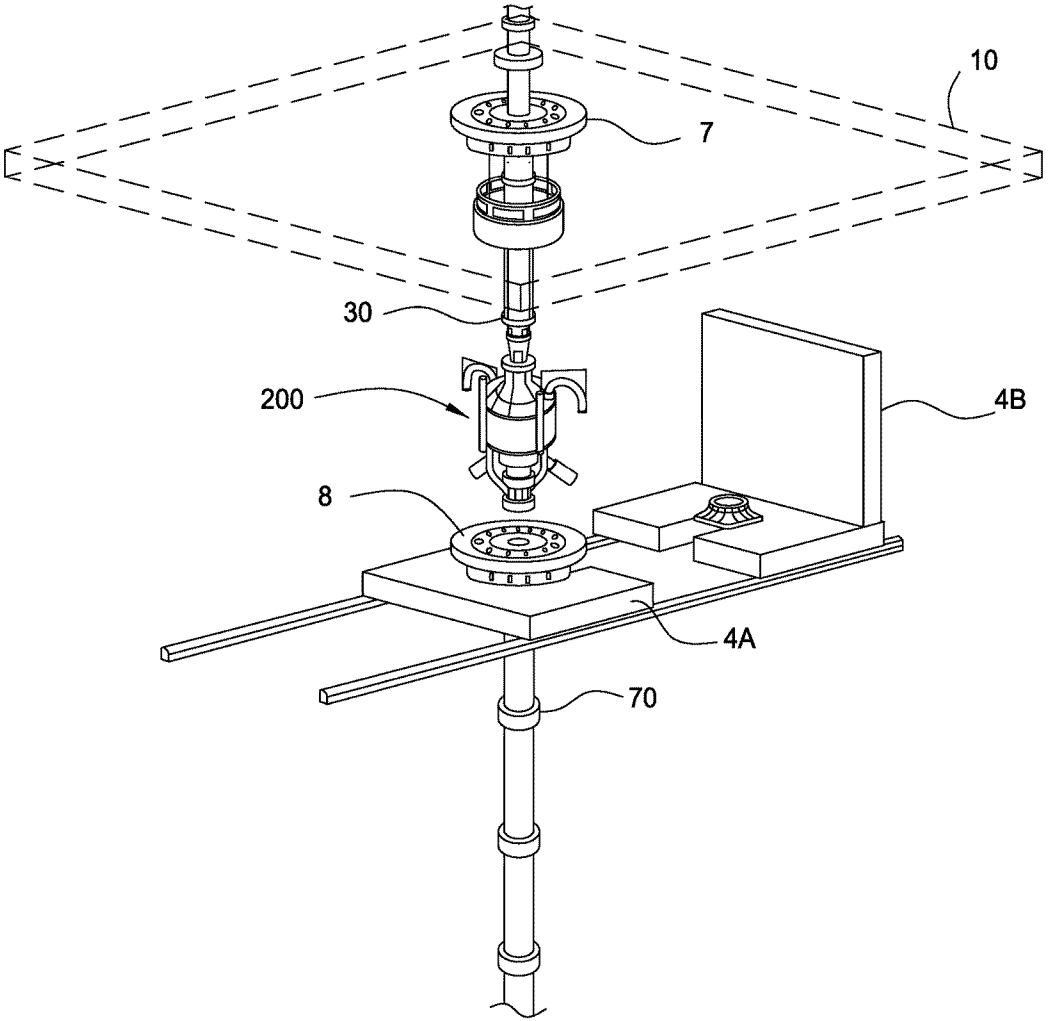

In FIG. 8, the telescopic joint 20, 30 and the fluid handling system 200 may be raised slightly using the drilling system 11. The first trolley 4A may move the second tubular handling device 8 and the riser string 70 into alignment with the fluid handling system 200 over the subsea well center.

Figure 9:
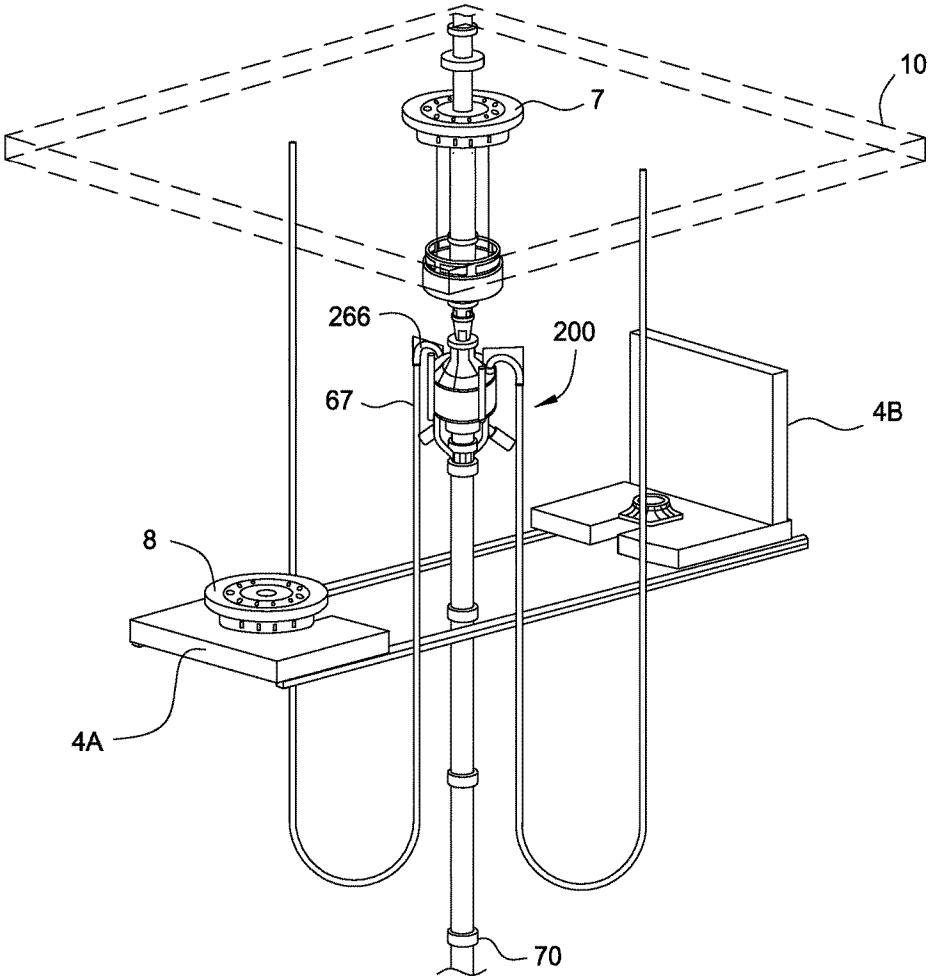

In FIG. 9, the telescopic joint 20, 30 and the fluid handling system 200 are lowered onto the riser string 70. The fluid handling system 200 is then connected to the riser string 70 such as by a flanged connection, thereby forming the riser package 100, according to one embodiment. The riser package 100 may then be raised and removed from being supported by the second tubular handling device 8. The first trolley 4A may then move the second tubular handling device 8 to a position that does not obstruct lowering of the riser package 100. The control lines, flow connections, gooseneck connections, and or any other equipment may also be installed at this point in the installation sequence.

Figure 10:
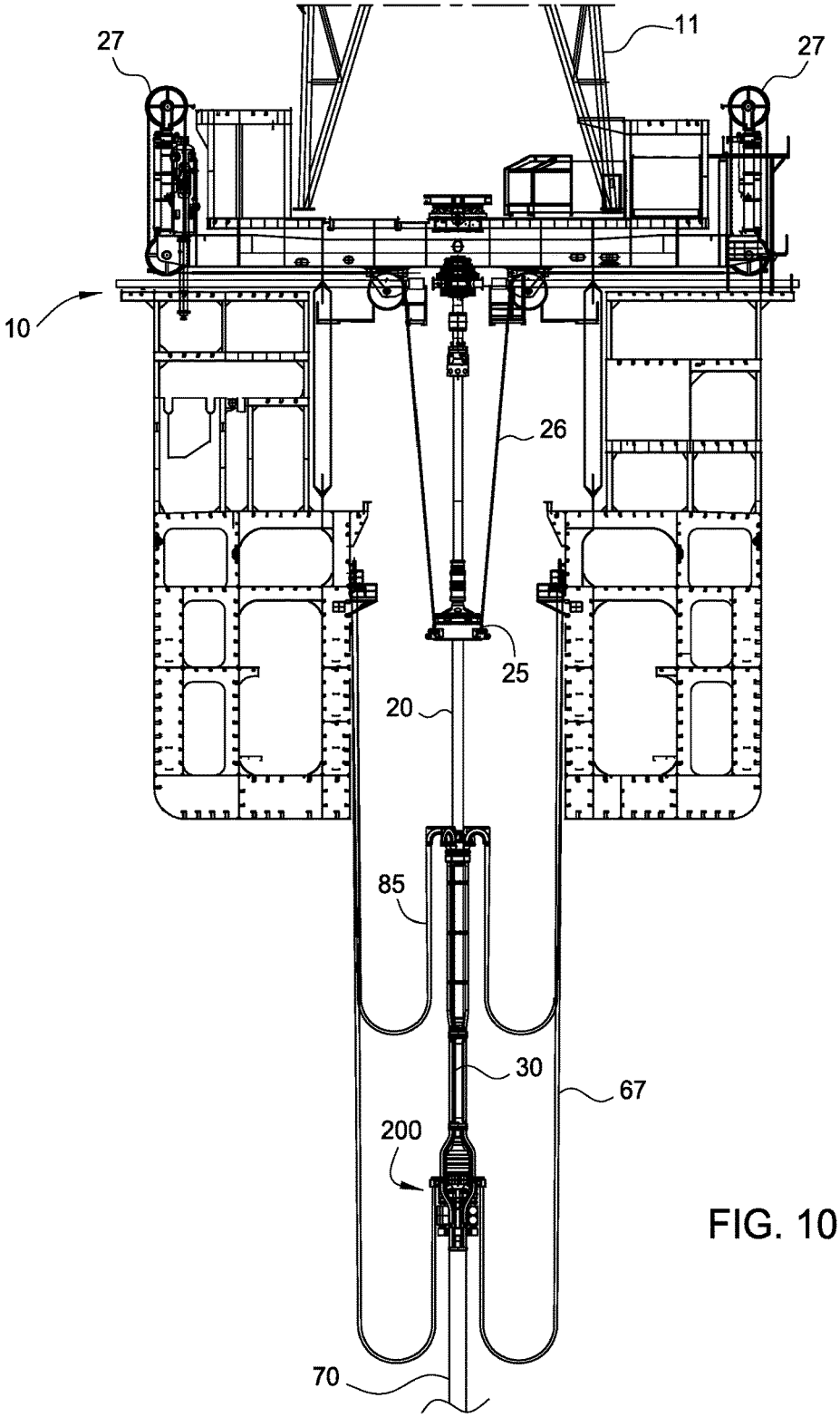

In FIG. 10, the riser package 100 may be lowered to a position where the control lines, flow connections, gooseneck connections, and/or any other equipment regarding the telescopic joint 20, 30 may also be installed. When complete, the riser package 100 may be lowered to a final operating position. The slip ring 25 via the cables 26 may be tensioned by the tensioners 27 on the rig 10 to support the weight of the riser package 100. Drilling operations may then be commenced in a conventional manner as known in the art.

Although not limited to the above recited installation process, one advantage of installing the fluid handling systems described herein using the above recited installation process is that the fluid handling systems do not need to be lowered through the first tubular handling device 7 located on the surface of the rig 10. Convention spiders and/or rotary tables located on rig surfaces may have a limited amount of space that is inadequate for running tools or other equipment of larger diameter sizes therethrough. In the event that the fluid handling system cannot be run through a spider and/or rotary table on the surface of a rig, the installation process described herein provides a novel and efficient technique for installation.

While the foregoing is directed to embodiments of the invention, other and further embodiments of the invention may be devised without departing from the basic scope thereof, and the scope thereof is determined by the claims that follow.

What is claimed is:

1. An apparatus to handle flow from a subsea component connected by a riser to drilling equipment on a rig, the rig having one or more first lines for communication with the apparatus and having one or more second lines for communication with the subsea component, the drilling equipment having a drillstring, the apparatus comprising:

a package having a first end connecting in fluid communication with a first section of the riser relative to the rig and having a second end connecting in fluid communication with a second section of the riser relative to the subsea component;

a first sealing device integrated into the package and having a first flow bore in fluid communication with the riser, the first sealing device having a first state opening the flow through the first flow bore between the first and second sections of the riser and having a second state at least partially closing the flow through the first flow bore between the first and second sections of the riser;

a flow device integrated into the package and having a second flow bore in fluid communication with the riser, the flow device having one or more valves in fluid communication with the second flow bore, the one or more valves having a third state permitting the flow between the second flow bore and the one or more first lines and having a fourth state closing the flow between the second flow bore and the one or more first lines;

a second sealing device having a third flow bore in fluid communication with the riser, the second sealing device having an annular seal configured to seal an annulus between the third flow bore and the drillstring of the drilling equipment passing therethrough; and one or more line segments integrated into the package and positioned between the first and second ends of the package, the one or more line segments communicating at the first end with the one or more second lines extending from a point along the riser uphole of the package, the one or more line segments communicating at the second end with the one or more second lines extending in communication with the subsea component downhole of the package.

2. The apparatus of claim 1, further comprising:

at least one first control system disposed in operable control of the first sealing device and the flow device and disposed in fluid communication at least with the one or more first lines, the at least one first control system having a first configuration actuating at least the first sealing device in the first state, the at least one first control system having a second configuration actuating the first sealing device in the second state and actuating the one or more valves in the third state, the at least one first control system in the second configuration diverting an uncontrolled release of the flow in the riser from the package and away from the drilling equipment.

3. The apparatus of claim 2, further comprising a second control system different from the at least one first control system, the second control system disposed in fluid communication with the one or more second lines and disposed in operable control at least with the subsea component.

4. The apparatus of claim 2, wherein the at least one first control system having the first configuration further actuates the one or more valves in the third and/or fourth states.

5. The apparatus of claim 2, wherein the at least one first control system operated in the first configuration actuates the first sealing device in the first state and actuates the one or more valves in the third state to control pressure in the annulus sealed by the annular seal of the second sealing device during drilling.

6. The apparatus of claim 1, further comprising a control manifold disposed in fluid communication with at least one of the one or more valves of the flow device via the one or more first lines, the control manifold receiving the flow from the at least one valve in the third state and configured to reduce a rate and a pressure of the received flow.

7. The apparatus of claim 1, further comprising a control manifold disposed in fluid communication with at least one of the one or more valves of the flow device via the one or more first lines, the control manifold in fluid communication with a supply fluid and configured to inject the supply fluid into the second flow bore through the at least one valve in the third state.

8. The apparatus of claim 1, further comprising a control manifold disposed in fluid communication with at least one of the one or more valves of the flow device via the one or more first lines, the control manifold receiving the flow from the at least one valve in the third state in an over-pressurized release and configured to selectively divert the over-pressurized release.

9. The apparatus of claim 1, wherein the first sealing device comprises a seal and a piston configured to move the seal into a closed position to at least partially close the first flow bore of the sealing device.

10. The apparatus of claim 9, wherein the seal and the piston are configured to move the seal to completely close off the first flow bore of the first sealing device.

11. The apparatus of claim 9, further comprising an accumulator integrated into the package, the accumulator disposed adjacent to the first sealing device and configured to supply hydraulic fluid to actuate the piston.

12. The apparatus of claim 1, wherein the first sealing device comprises a rotating or a non-rotating seal configured to at least partially close the first flow bore of the first sealing device.

13. The apparatus of claim 1, wherein the flow device comprises a lateral flow bore intersecting the second flow bore and disposed in fluid communication with the one or more valves.

14. The apparatus of claim 13, wherein the one or more valves are hydraulically actuated to open and close the flow between the lateral flow bore and the one or more first lines.

15. The apparatus of claim 14, further comprising one or more accumulators integrated into the package, the one or more accumulators disposed adjacent to the one or more valves and configured to supply hydraulic fluid to actuate the one or more valves.

16. The apparatus of claim 1, further comprising a telescopic joint for a tensioning system between the riser and the rig, the telescopic joint disposed on the first section of the riser uphole of the package.

17. The apparatus of claim 1, further comprising one or more gooseneck connectors disposed on the first section of the riser at the point along the riser uphole of the package for connection to the one or more second lines from the rig.

18. The apparatus of claim 1, further comprising one or more gooseneck connectors integrated into the package for connection to the one or more first lines from the rig.

19. The apparatus of claim 1, wherein the second sealing device is integrated into the package.

20. The apparatus of claim 19, wherein the second sealing device is integrated uphole of the first sealing device in the package.

21. The apparatus of claim 1, further comprising a control manifold disposed in fluid communication with at least one of the one or more valves of the flow device via the one or more first lines, the control manifold receiving the flow from the at least one valve in the third state and configured to manage pressure of the flow of the sealed annulus in a drilling operation.

22. The apparatus of claim 1, comprising:

a first adapter integrated on the package toward the first end of the package and coupleable to the first section of the riser relative to the drilling equipment; and a second adapter integrated on the package toward the second end of the package and coupleable relative to the second section of riser relative to the subsea component.

23. A method of installing an apparatus to handle flow from a subsea component connected by a riser to drilling equipment on a rig, the rig having one or more first lines for communication with the apparatus and having one or more second lines for communication with the subsea component, the method comprising:

supporting at least a portion of the riser extending below the rig;

supporting at least a portion of a telescopic joint of the riser above the riser portion;

moving a package at least having a first sealing device, a flow device, and one or more line segments integrated therein into alignment beneath the telescopic joint portion, the first sealing device configured to control flow through the package;

connecting an upper end of the package to the telescopic joint portion;

moving a lower end of the package into alignment above the riser portion;

connecting the lower end of the package to the riser portion;

connecting the one or more first lines at least to one or more valves of the flow device of the package, the one or more valves configured to control the flow between the package and the one or more first lines;

connecting one or more second ends of the one or more line segments to part of the one or more second lines extending along the riser portion;

connecting a structural support on the riser at a point at least between the package and the telescopic joint; and connecting one or more first ends of the one or more line segments to another part of the one or more second lines extending between the structural support and the package.

24. An apparatus to handle flow from a subsea component connected by a riser to drilling equipment on a rig, the rig having one or more first lines for communication with the apparatus and having one or more second lines for communication with the subsea component, the drilling equipment having a drillstring, the apparatus comprising:

a package having a first end connecting in fluid communication with a first section of the riser relative to the rig and having a second end connecting in fluid communication with a second section of the riser relative to the subsea component;

a first sealing device integrated into the package and having a first flow bore in fluid communication with the riser, the first sealing device having a first state opening the flow through the first flow bore between the first and second sections of the riser and having a second state at least partially closing the flow through the first flow bore between the first and second sections of the riser;

a flow device integrated into the package and having a second flow bore in fluid communication with the riser, the flow device having one or more valves in fluid communication with the second flow bore, the one or more valves having a third state permitting the flow between the second flow bore and the one or more first lines and having a fourth state closing the flow between the second flow bore and the one or more first lines;

one or more line segments integrated into the package and positioned between the first and second ends of the package, the one or more line segments communicating at the first end with the one or more second lines extending from a point along the riser uphole of the package, the one or more line segments communicating at the second end with the one or more second lines extending in communication with the subsea component downhole of the package; and a control manifold disposed in fluid communication with at least one of the one or more valves of the flow device via the one or more first lines, the control manifold receiving the flow from the at least one valve in the third state and configured to reduce a rate and a pressure of the received flow.

25. An apparatus to handle flow from a subsea component connected by a riser to drilling equipment on a rig, the rig having one or more first lines for communication with the apparatus and having one or more second lines for communication with the subsea component, the drilling equipment having a drillstring, the apparatus comprising a package having a first end connecting in fluid communication with a first section of the riser relative to the rig and having a second end connecting in fluid communication with a second section of the riser relative to the subsea component;

a first sealing device integrated into the package and having a first flow bore in fluid communication with the riser, the first sealing device having a first state opening the flow through the first flow bore between the first and second sections of the riser and having a second state at least partially closing the flow through the first flow bore between the first and second sections of the riser;

a flow device integrated into the package and having a second flow bore in fluid communication with the riser, the flow device having one or more valves in fluid communication with the second flow bore, the one or more valves having a third state permitting the flow between the second flow bore and the one or more first lines and having a fourth state closing the flow between the second flow bore and the one or more first lines;

one or more line segments integrated into the package and positioned between the first and second ends of the package, the one or more line segments communicating at the first end with the one or more second lines extending from a point along the riser uphole of the package, the one or more line segments communicating at the second end with the one or more second lines extending in communication with the subsea component downhole of the package; and a control manifold disposed in fluid communication with at least one of the one or more valves of the flow device via the one or more first lines, the control manifold in fluid communication with a supply fluid and configured to inject the supply fluid into the second flow bore through the at least one valve in the third state.

26. An apparatus to handle flow from a subsea component connected by a riser to drilling equipment on a rig, the rig having one or more first lines for communication with the apparatus and having one or more second lines for communication with the subsea component, the drilling equipment having a drillstring, the apparatus comprising a package having a first end connecting in fluid communication with a first section of the riser relative to the rig and having a second end connecting in fluid communication with a second section of the riser relative to the subsea component;

a first sealing device integrated into the package and having a first flow bore in fluid communication with the riser, the first sealing device having a first state opening the flow through the first flow bore between the first and second sections of the riser and having a second state at least partially closing the flow through the first flow bore between the first and second sections of the riser;

a flow device integrated into the package and having a second flow bore in fluid communication with the riser, the flow device having one or more valves in fluid communication with the second flow bore, the one or more valves having a third state permitting the flow between the second flow bore and the one or more first lines and having a fourth state closing the flow between the second flow bore and the one or more first lines;

one or more line segments integrated into the package and positioned between the first and second ends of the package, the one or more line segments communicating at the first end with the one or more second lines extending from a point along the riser uphole of the package, the one or more line segments communicating at the second end with the one or more second lines extending in communication with the subsea component downhole of the package; and a control manifold disposed in fluid communication with at least one of the one or more valves of the flow device via the one or more first lines, the control manifold receiving the flow from the at least one valve in the third state in an over-pressurized release and configured to selectively divert the over-pressurized release.

* * * * *